United States Patent [19]

Drutchas et al.

[11] Patent Number: 4,516,918

[45] Date of Patent: May 14, 1985

[54] PUMP ASSEMBLY

[75] Inventors: Gilbert H. Drutchas, Birmingham; Phillip B. Spencer, Troy, both of Mich.

[73] Assignee: TRW Inc., Cleveland, Ohio

[21] Appl. No.: 381,702

[22] Filed: May 25, 1982

[51] Int. Cl.[3] ..... F04C 2/00; F04C 15/02

[52] U.S. Cl. ..... 418/15; 418/102; 418/267; 418/270

[58] Field of Search ..... 418/15, 268, 266, 267, 418/102, 270

[56] References Cited

U.S. PATENT DOCUMENTS

| | | | |
|---|---|---|---|
| 2,832,199 | 4/1958 | Adams et al. | 418/15 X |
| 2,861,517 | 11/1958 | Neff | 418/267 X |
| 3,368,799 | 2/1968 | Sluijters | 418/102 |
| 3,385,513 | 5/1968 | Kilgore | 418/82 |
| 3,424,094 | 1/1969 | Clark et al. | 418/267 |
| 3,714,969 | 2/1973 | Hanning | 418/268 X |
| 3,790,307 | 2/1974 | Aldinger . | |
| 3,852,003 | 12/1974 | Adalbert et al. | 418/268 X |
| 3,900,277 | 8/1975 | Newton . | |
| 3,981,641 | 9/1976 | D'Amato | 418/102 X |
| 4,080,124 | 3/1978 | Drutchas et al. . | |
| 4,345,886 | 8/1982 | Nakayama et al. | 418/102 X |
| 4,384,828 | 5/1983 | Rembold et al. | 418/102 X |
| 4,443,169 | 4/1984 | Merz | 418/15 X |

FOREIGN PATENT DOCUMENTS

| | | |
|---|---|---|
| 333308 | 2/1921 | Fed. Rep. of Germany . |
| 2540879 | 7/1977 | Fed. Rep. of Germany . |
| 1066760 | 6/1954 | France . |

OTHER PUBLICATIONS

Literature re ZF Radial Piston Pump.

*Primary Examiner*—John J. Vrablik
*Assistant Examiner*—T. Olds
*Attorney, Agent, or Firm*—Yount & Tarolli

[57] ABSTRACT

An improved pump assembly includes a plurality of pumping elements which rotate with a rotor and engage an inner surface of a cam ring to define pumping chambers which hold liquid and/or air. As the pumping chambers move along an inlet arc, liquid flows through an orifice to the chambers. The orifice restricts the rate of flow of liquid to the pumping chambers to a flow rate which is insufficient to fill the chambers with liquid during high speed rotation of the rotor. As the pumping chambers move along an outlet arc which has a constant slope toward the rotor, the volume of each pumping chamber is decreased. When the fluid pressure in the pumping chamber exceeds a pump discharge pressure, one of a series of a check valves opens and fluid is discharged from the pumping chamber. The check valves are resiliently deflectable spring fingers which are connected with an end plate of the pump assembly and are urged toward the closed position by a fluid pressure force which varies as a function of variations in pump discharge pressure. Bearings for supporting the rotor are lubricated by a flow of liquid from the pumping chambers through passages formed between the rotor and the end plates.

13 Claims, 17 Drawing Figures

PUMP ASSEMBLY

BACKGROUND OF THE INVENTION

The present invention relates to a quietly operating pump assembly which is effective to reduce the torque required to drive it when a predetermined operating speed is exceeded.

Prior to the making of the invention disclosed herein, it was suggested that the size of the inlet to a slipper pump could be reduced to limit the rate at which liquid can enter the pump. Limiting the inlet flow rate would decrease the torque required to drive the pump at relatively high speeds. It was also suggested that the slippers be mounted to prevent a back flow of fluid from the pump outlet into pumping chambers other than the chamber at the pump outlet. With such an arrangement, each slipper would be disposed in a recess in a rotor. The slipper would sealingly engage both the trailing edge of its rotor recess and a cam ring encircling the rotor. Therefore the slippers blocked a back flow of fluid from the pump outlet to the pumping chambers other than the pumping chamber at the pump outlet. This suggested pump design did not have plural outlet openings or check valves separate from the slippers of the pump. In addition, this suggested pump was noisy and had a fluctuating fluid pressure output.

U.S. Pat. No. 3,790,307 discloses a pump having hollow pistons which internally define pumping chambers. The pumping chambers move along a circular path circumscribed by a cam ring. In sequential portions of their movement, the chambers move past a series of inlet openings and a series of outlet openings. A plurality of check valves in the outlet openings prevent a flow of fluid from the outlet of the pump back into the pumping chambers. When the fluid pressure in the pumping chambers exceeds the outlet fluid pressure, the check valves open and fluid flows from the chambers to the pump outlet.

SUMMARY OF THE PRESENT INVENTION

The present invention is a pump assembly which, once a predetermined operating speed has been reached, reduces the amount of torque required to drive the pump assembly without decreasing the rate of fluid flow from the pump assembly. By reducing the amount of torque required to drive the pump assembly at relatively high speeds, substantial energy savings may be obtained.

The pump assembly is a slipper vane pump and includes a rotor in which pumping elements, i.e., slipper vanes, are mounted. The pumping elements engage an inner surface of a cam ring. In order to effect a reduction in torque, the pump assembly has a fluid inlet orifice which, after a predetermined pump operating speed has been exceeded, restricts the flow of liquid into the pumping chambers of the pump assembly. Therefore, at relatively high operating speeds, each pumping chamber is only partially filled with liquid.

As a pumping chamber moves along an outlet arc, the size of the pumping chamber is reduced at a constant rate and the fluid pressure in the pumping chamber is increased. A plurality of outlets are disposed along the outlet arc. A check valve is associated with each of the outlets. Each check valve blocks fluid flow from a pumping chamber until the fluid pressure in the chamber is at least as great as the pressure at which fluid is being discharged from the pump assembly. The check valves thus tend to minimize objectionable backflow and shock waves in the pumping chambers with a resulting reduction in noise generated during operation of the pump assembly.

The check valves may be resilently deflectable spring fingers. The spring fingers are biased toward a closed position by pump discharge pressure applied against outer surfaces of the spring fingers. The inner surfaces of the spring fingers are exposed to the fluid pressure in each of the pumping chambers in turn. When the fluid pressure in a pumping chamber exceeds the pump discharge pressure, a spring finger is moved from a closed condition to an open condition.

A smooth quiet flow of fluid from the pump assembly is promoted by providing the cam ring with an outlet arc which decreases in radius at a constant rate along the outlet arc. This results in each of the pumping elements being moved radially inwardly through the same incremental distance for each arcuate increment of movement of a pumping element along the outlet arc. Therefore the size of a pumping chamber is decreased by the same amount on each arcuate increment of movement of a pumping chamber along the outlet arc. A bearing for the pump assembly's rotor is lubricated by fluid conducted from the pumping chambers to the bearing along a flow path which includes a passage formed between an end section of the pump and the rotor.

Accordingly, it is an object of this invention to provide a new and improved rotary pump assembly which reduces the amount of torque required to drive the pump assembly without reducing the rate at which fluid is discharged from the pump assembly and without generating excessive noise once a predetermined pump operating speed is exceeded.

Another object of this invention is to provide a new and improved pump assembly wherein a plurality of resiliently deflectable spring finger valves are connected in fluid communication with an outlet arc and are biased toward a closed condition to maintain the valves closed until the fluid pressure conducted from a pumping chamber to a valve is sufficient to overcome the influence of the biasing force.

Another object of this invention is to provide a new and improved pump assembly which has a circular array of pumping chambers formed by cooperation between pumping elements mounted on a rotor, a cam ring and end sections disposed adjacent to opposite axial ends of the rotor and in which a rotor support bearing is lubricated by fluid conducted from the pumping chambers to the bearing along a path which includes a passage formed between the rotor and one of the end sections.

Another object of this invention is to provide a new and improved pump assembly having a circular array of pumping chambers which are at least partially defined by cooperation between a cam ring and a plurality of pumping elements and wherein the cam ring has an outlet arc which decreases pumping chamber size at a constant rate during movement of a pumping chamber along the outlet arc.

BRIEF DESCRIPTION OF THE DRAWINGS

The foregoing and other objects and features of the present invention will become more apparent upon a consideration of the following description taken in connection with the accompanying drawings wherein.

DESCRIPTION OF SPECIFIC PREFERRED EMBODIMENTS OF THE INVENTION

Pump Assembly—General Description

Figure 1:
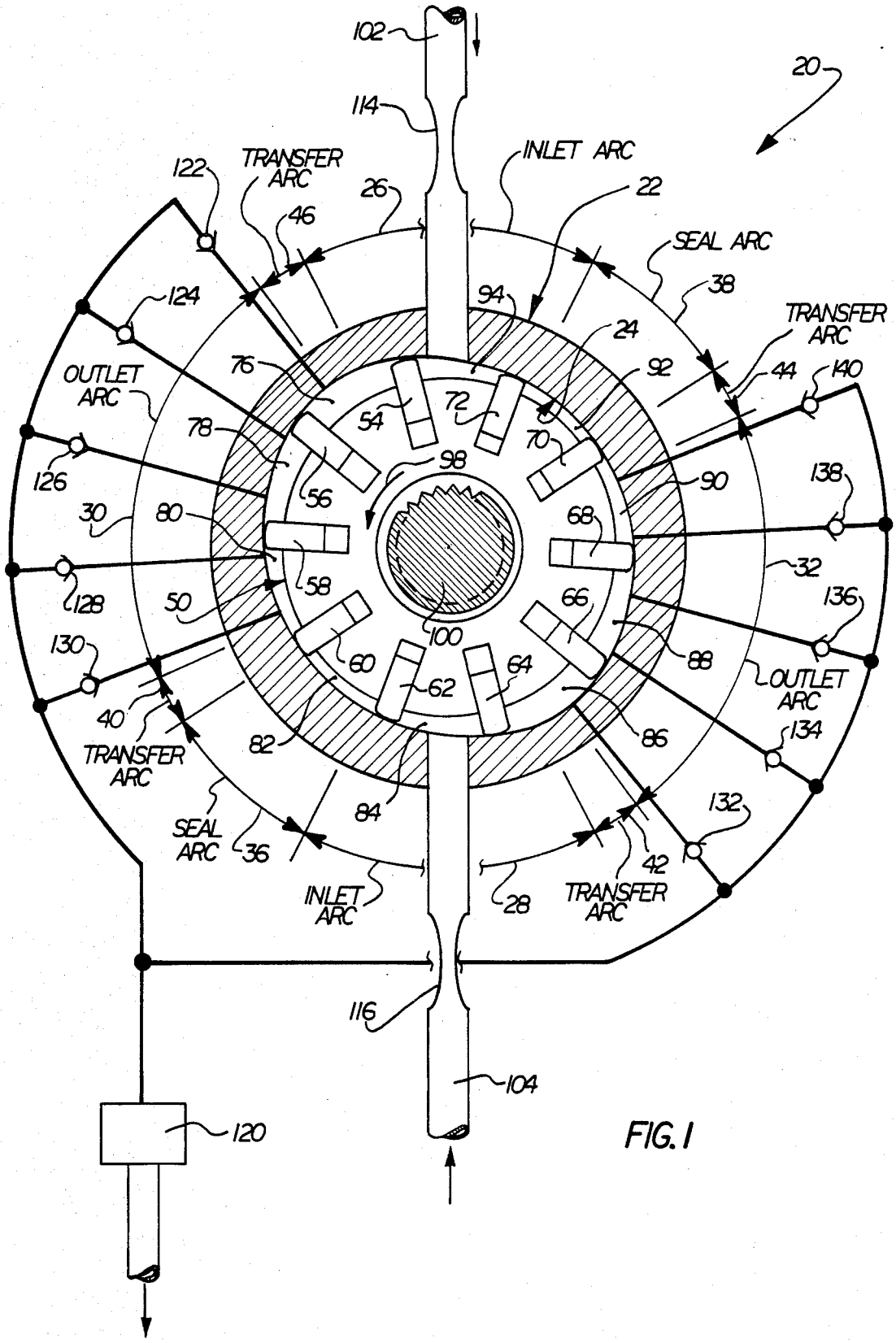
FIG. 1 is a schematic illustration of a pump assembly constructed in accordance with the present invention.

A pump assembly 20 constructed in accordance with the present invention is illustrated schematically in FIG. 1. The torque required to drive the pump assembly 20 is reduced when its operating speed exceeds a predetermined operating speed. Once the predetermined operating speed is exceeded, the rate of fluid flow from the pump assembly 20 remains substantially constant even though the torque required to drive the pump assembly is reduced. This is accomplished by reducing the volume of liquid discharged from the pump assembly 20 on each revolution or operating cycle as pump operating speed increases.

The pump assembly 20 includes a cam ring 22 having a radially inner circumferential surface 24 which defines a pair of diametrically opposite inlet arcs 26 and 28. The surface 24 of the cam ring also defines a pair of diametrically opposite outlet arcs 30 and 32 which are substantially longer than the inlet arcs 26 and 28. Constant radius tangent or seal arcs 36 and 38 are provided between outlet arc 30 and inlet arc 28 and between outlet arc 32 and inlet arc 26, respectively. In addition, transfer or transition arcs 40, 42, 44 and 46 provide transition between the various cam ring arcs in a known manner.

A cylindrical rotor 50 is disposed in and is circumscribed by the cam ring 22. Pumping elements or vanes 54, 56, 58, 60, 62, 64, 66, 68, 70 and 72 are slidably mounted in the rotor 50 and are urged radially outwardly into sealing engagement with the inner surface 24 of the cam ring 22. The vanes 54–72 cooperate with the cam ring 22 and the end plates or sections (not shown) for the pump assembly to define a circular array of arcuate pumping chambers 76, 78, 80, 82, 84, 86, 88, 90, 92 and 94. The chambers 76–94 hold liquid and/or air and are moved along a circular path as the rotor 50 is rotated in a counterclockwise direction, indicated by the arrow 98 in FIG. 1, by rotation of a drive shaft 100.

During rotation of the rotor 50, liquid is supplied to the inlet arcs 26 and 28 through conduits 102 and 104. As each of the pumping chambers 76–94 moves along one of the inlet arcs 26 and 28, the vanes that define the chamber move radially outwardly and the chamber expands to reduce the pressure in it. The pressure reduction draws liquid from one of the conduits 102 and 104 into the pumping chamber.

As each pumping chamber continue to move along its circular path within the cam ring 22, the chamber sequentially moves from one of the relatively short inlet arcs 26 and 28 to one of the relatively long outlet arcs 30 and 32. As a pumping chamber moves along the outlet arc 30 or 32, the vanes defining the chamber are forced radially inwardly and the chamber contracts at a constant rate to increase the pressure in it. The pressure increase forces liquid from the pumping chamber into one or more of a series of outlet lines (unnumbered), as will be described in more detail hereafter.

During operation of the pump assembly 20, the torque required to drive the assembly decreases as the operating speed of the assembly increases above a predetermined speed. The torque is a function of the product of (a) fluid pressure and (b) the volume of fluid discharged from the pump assembly 20 on each revolution of the rotor 50. Normally, the volume of fluid discharged on each revolution of the rotor remains constant, and torque also remains constant despite increasing speed. The reduction in torque required to operate the pump assembly 20 with increasing speed above a predetermined speed is achieved by decreasing the volume of fluid discharged on each revolution of the rotor 50. Because the rate at which fluid is discharged from the pump assembly 20 is a function of the product of (a) the speed of the pump and (b) the volume of fluid discharged on each revolution, the increasing speed of the pump will offset the decreasing volume discharged per revolution of the pump, thereby maintaining substantially constant the rate at which fluid is discharged from the pump assembly per unit of time.

Figure 2:
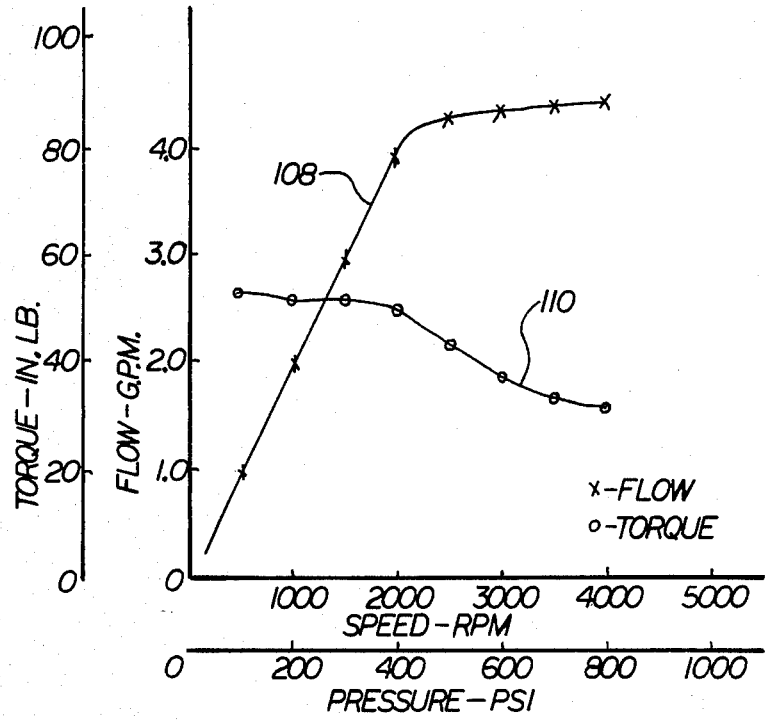
FIG. 2 is a graph illustrating typical flow versus speed and torque versus speed curves for a pump assembly constructed in a manner similar to that illustrated in FIG. 1.

The general relationships between liquid flow rate from the pump assembly 20 and pump operating speed and between the torque required to drive the pump assembly and operating speed are indicated in the graph of FIG. 2. (It should be understood that FIG. 2 literally illustrates the operating characteristics of a specific pump assembly constructed in accordance with the embodiment of the invention illustrated in FIGS. 4 to 16, not shown in FIG. 1.) As shown by curve 108 in FIG. 2, the rate of flow of fluid from the pump assembly increases linearly with increasing speed until a flow rate of approximately 4.2 gallons per minute is obtained at a pump operating speed of approximately 2,250 revolutions per minute. Further increases in pump speed do not significantly increase the rate at which fluid is discharged from the pump. Curve 110 shows that a torque of approximately 50 inch pounds must be applied to the drive shaft of the pump assembly to turn the assembly at speeds up to approximately 2,000 revolutions per minute. As pump speed increases to 3,000 revolutions per minute, however, the torque required to drive the pump assembly drops to approximately 38 inch pounds. Thus, the torque decreases, and the flow remains substantially constant, after a predetermined maximum flow rate, e.g., 4.2 gallons per minute, is obtained.

As previously explained, to reduce the torque required to drive the pump assembly at speeds above a speed corresponding to a predetermined maximum flow, the volume of liquid discharged on each revolution of the rotor 50 must be reduced. To reduce the discharge volume, the volume of fluid that flows into each of the pumping chambers must be reduced. Specifically, the rate at which liquid can flow into each of the pumping chambers 76 to 94 is restricted by orifices 114 and 116 (FIG. 1) in the conduits 102 and 104, respectively. The cross sectional area of each of the orifices 114 and 116 is selected such that until a preselected inlet flow rate is achieved, liquid flows through the conduits 102, 104 and the orifices 114 and 116 at a rate sufficient to fill each of the pumping chambers in turn as the chambers move through the inlet arcs 26 and 28. Consequently, the rate at which liquid is discharged from the pump assembly 20 varies directly as a function of pump operating speed.

When the flow rate through the conduits 102 and 104 and the orifices 114 and 116 reaches the predetermined maximum inlet flow rate, the orifices begin to restrict the rate of flow into the pumping chambers. Thus, as the speed of the pump continues to increase, the restricted flow of fluid is insufficient to fill each of the pumping chambers. Since each of the pumping chambers is only partially filled with liquid, the volume of liquid which is discharged from the pumping chambers at the outlet arcs 30 and 32 on each revolution of the rotor 50 is decreased. Due to the increasing operating speed of the pump assembly 20, however, the flow of liquid from the pump assembly per unit of time remains substantially constant. At the same time, because the volume of liquid which is discharged from the pumping chambers on each revolution of the rotor decreases, the torque required to drive the pump also decreases.

The outlet arcs 30 and 32 are connected in fluid communication with a pump discharge pressure chamber 120 (FIG. 1) through a plurality of check valves 122, 124, 126, 128, 130, 132, 134, 136, 138 and 140. If desired, the check valves 122–140 may be mounted on the cam ring 22. The check valves 122–140 are biased toward a closed condition by the fluid pressure in the pump discharge chamber 120. The check valves 122–140 are urged toward the open condition by the fluid pressure at spaced apart locations along the outlet arcs 30 and 32.

Only when the fluid pressure conducted to one of the check valves 122–140 from one of the pumping chambers 76–94 is sufficient to overcome the biasing pressure from the pump discharge chamber 120 does the check valve open. This prevents a backflow of fluid from the pump discharge chamber 120 to the pumping chambers. Such a backflow of liquid into the pumping chambers would cause shock waves of high amplitude and pressure. The shock waves would vibrate the vanes and cause operating noise and stress on the components of the pump assembly.

During operation of the pump assembly 20 at relatively low speeds so that the rate of flow of liquid through the orifices 114 and 116 is sufficient to fill each of the pumping chambers completely, all of the check valves 122–140 are operated. As pumping chamber 76, for example, moves along the outlet arc 30, the vanes 54 and 56 are forced radially inwardly to decrease the volume of the chamber. The outlet arc 30 has a constant slope inwardly toward the center of rotation of the drive shaft 100 so that for each increment of movement of the vane 56 along the outlet arc 30, the vane is moved radially inwardly through the same incremental distance. As a result, there is in a smooth increase in the fluid pressure in the pumping chamber 76. The fluid pressure sequentially opens each of the check valves 122–130 against the fluid pressure conducted from the pump discharge chamber 120.

Once one of the check valves has opened, the arcuate spacing between the check valves 122–130 and between the vanes 54 and 56 is such that the pumping chamber is always connected in fluid communication with two of the check valves 122–130 until the pumping chamber has partially cleared the end of the outlet arc 30. This promotes a smooth flow of fluid from the pumping chamber 76 as it moves along the outlet arc.

During operation of the pump assembly 20 at relatively high speeds, the orifices 114 and 116 restrict the flow of liquid to the pumping chambers 76–94 so that they are only partially filled with liquid. The pumping chamber 76, for example, will be partially filled with air and will have a relatively low fluid pressure. As with low speed operation, the vanes 54 and 56 are forced radially inwardly to decrease the volume of the chamber while it moves through the outlet arc 30. The pressure in the chamber increases as the volume decreases, forcing the air into solution with the liquid. The chamber's volume must be substantially reduced, however, before the fluid pressure in the chamber will overcome the pressure from the pump discharge chamber 120 and open one of the check valves 122–130. Thus, the pumping chamber 76 will move past the closed check valve 122 without opening it. Not until the fluid pressure in the chamber 76 slightly exceeds the pressure in the pump discharge chamber will a check valve be opened.

Once the fluid in the pumping chamber 76 has reached a pressure which is sufficient to open a check valve against the biasing pressure from the pressure chamber 120, the pumping chamber 76 remains connected in fluid communication with the pressure chamber through an open check valve until the pumping chamber leaves the outlet arc. Thus, the flow of liquid from the pumping chamber 76 is initiated at a location along the outlet arc 30 which varies depending upon the speed of operation of the pump assembly 20 and the extent to which the pumping chamber 76 is filled with liquid. At relatively high pump operating speeds, only the check valves 128 and 130 may be opened as the pumping chambers move along the outlet arc 30. The fluid pressure in the pumping chambers may be insufficient to open the check valves 122, 124, 126.

Figure 3:
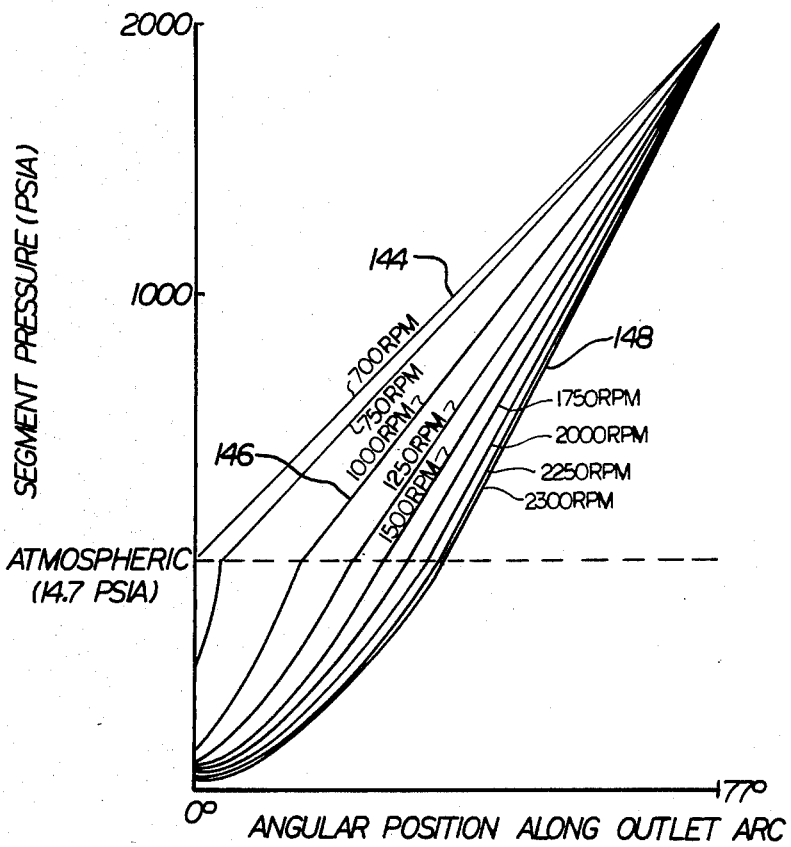
FIG. 3 is a graph illustrating a typical relationship between fluid pressure in a pumping chamber and the position of the pumping chamber along an outlet arc for a pump assembly constructed in a manner similar to that illustrated in FIG. 1.

The manner in which the fluid pressure in one pumping chamber of a specific pump assembly varies along the outlet arc 30 with variations in pump speed is illustrated in the graph of FIG. 3. Thus, at a pump speed of approximately 700 rpm, indicated by the curve 144, the fluid pressure in the pumping chamber is approximately equal to atmospheric pressure (14.7 psia) when the pumping chamber moves into the outlet arc 30. As the pumping chamber moves along the outlet arc, the fluid pressure in the pumping chamber increases linearly as indicated by the curve 144. Although FIG. 3 does not show it, once the fluid pressure in a pumping chamber is sufficient to open one of the check valves 122–140, the pressure in the pumping chamber is substantially equal to the pressure in the discharge chamber 120. The pressure curves of FIG. 3 are no longer applicable after the check valves open.

As the operating speed of the specific pump assembly whose characteristics are indicated in FIGS. 2 and 3 increases, the fluid pressure in the pumping chambers when they enter the outlet arc decreases. Thus, at a pump assembly speed of approximately 1,000 rpms, as indicated by the curve 146 in FIG. 3, the fluid pressure in the pumping chamber is approximately 10.5 psia when the pumping chamber enters the outlet arc. As the pumping chamber moves along the outlet arc through an arcuate distance of approximately 13 degrees, the constant inward slope of the surface of the outlet arc 30 causes the pressure in the pumping chamber increase to atmospheric pressure. Thereafter, the pumping chamber pressure increases in the linear manner indicated by the curve 146 in FIG. 3. When the pump assembly is being operated at a speed of approximately 2,250 rpm, the manner in which fluid pressure in a pumping chamber increases along the outlet arc is indicated by the curve 148 in FIG. 3.

The performance curves of FIGS. 2 and 3 will be different for different pump assemblies. In addition, the relationship between the performance curves will be different for different pump assemblies. The specific performance curves shown in FIGS. 2 and 3 are for a pump assembly having the same general construction as the pump assembly of the embodiment of the invention shown in FIGS. 4–16. However, the performance curves for the pump assembly 20 will be similar to the performance curves of FIGS. 2 and 3.

Pump Assembly—One Specific Preferred Embodiment

In the embodiment of the invention illustrated schematically in FIG. 1, the pump assembly 20 is a vane pump. To facilitate construction, however, the pump assembly 20 may be a slipper pump. In addition, in the embodiment of the invention shown in FIG. 1, the check valves 122–140 are connected in fluid communication with the outlet arcs 30 and 32 by passages which extend through the cam ring 22. The check valves 122–140 could be connected with the outlet arcs, however, by passages which extend through an end section of the pump assembly.

In the specific preferred embodiment of the invention illustrated in FIGS. 4–16, the pump assembly 154 is a slipper pump and has check valves which are connected in fluid communication with outlet arcs by passages extending through an end section or pressure plate of the pump assembly. Despite the differences between its construction and the construction of the pump assembly 20 illustrated schematically in FIG. 1, the pump assembly 154 requires less torque to drive it when its operating speed exceeds a predetermined operating speed. Also, once the predetermined operating speed is exceeded, the rate of fluid flow from the pump assembly 154 remains substantially constant. As with the pump assembly 20, the volume of liquid discharged from the pump assembly 154 on each revolution or operating cycle is reduced as pump operating speed increases.

Figure 12:
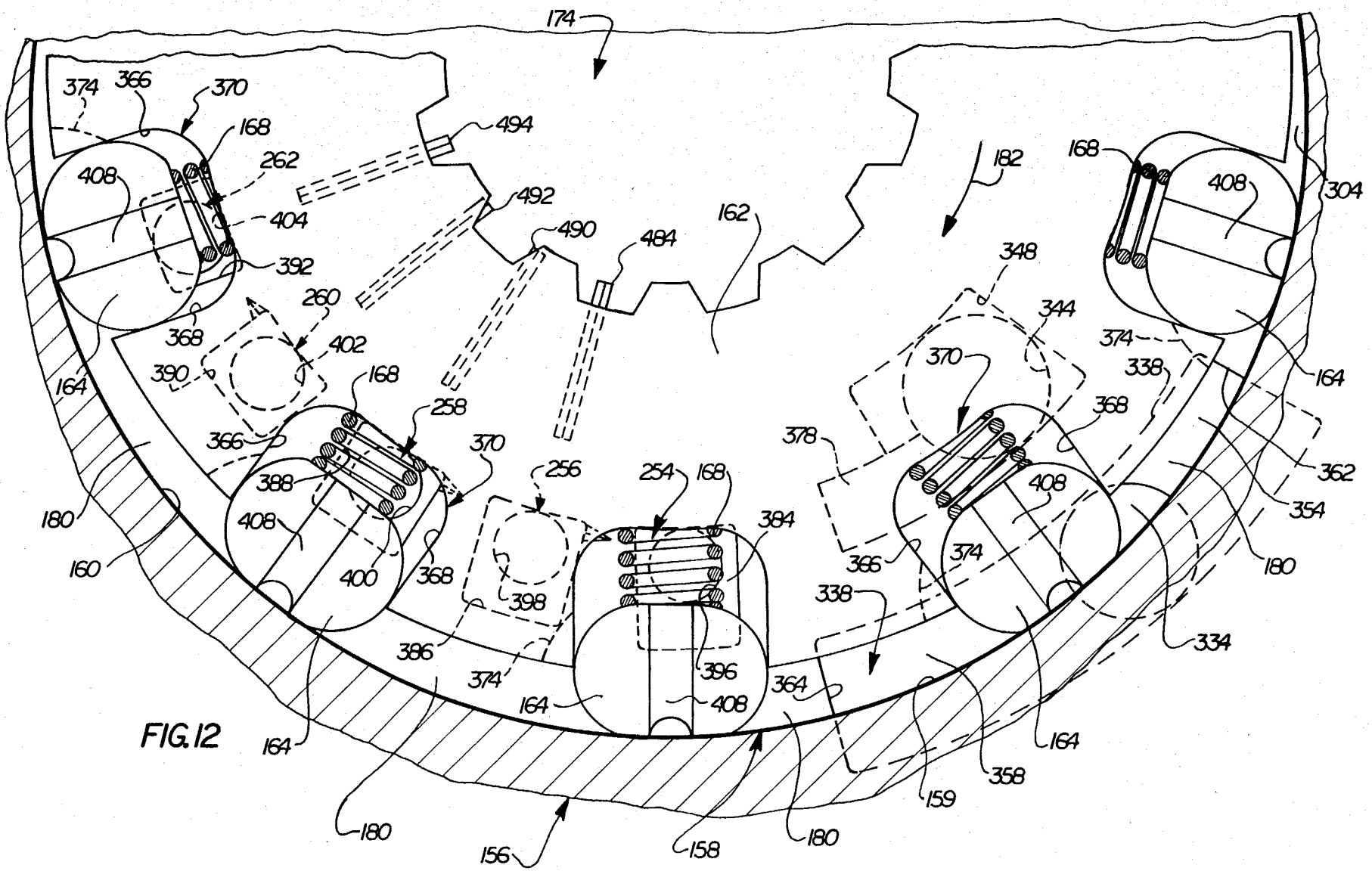
FIG. 12 (on sheet 8 of the drawings) is an enlarged fragmentary sectional view illustrating the relationship between a cam ring, rotor, pumping elements, and an outer end section or pressure plate of the pump assembly of FIG. 4.

The pump assembly 154 (FIG. 4) includes a cam ring 156 having an inner side surface 158 which defines two diametrically opposite inlet arcs and two diametrically opposite outlet arcs. One inlet arc 159 and one outlet arc 160 are shown in FIG. 12. The inlet and outlet arcs on the cam ring 156 have the same configuration as inlet arcs 26 and 28 and outlet arcs 30 and 32 of the pump assembly 20 in FIG. 1.

The inlet arcs on the cam ring 156 each have an arcuate extent of approximately 55°. The outlet arcs each have an arcuate extent of approximately 77° and slope radially inwardly toward the center of the cam ring 156 at a constant rate. Thus, for each arcuate increment along an outlet arc, the surface 158 of the cam ring moves closer to the center of the cam ring by the same incremental distance. The cam ring 156 also has constant radius tangent or seal arcs and transfer or transition arcs, as described previously in connection with the cam ring 22 of FIG. 1. The arcuate extents of the inlet and outlet arcs can be varied from the foregoing dimensions. Nonetheless, the outlet arcs should have arcuate extents which are substantially greater than the arcuate extents of the inlet arcs.

A cylindrical rotor 162 (see FIGS. 4 and 12) is circumscribed by the cam ring 156. A plurality of pumping elements or slippers 164 are slidably mounted on the rotor 162. The slippers 164 are urged radially outwardly into sealing engagement with the inner side surface 158 of the cam ring 156 by biasing springs 168. The slippers 164 cooperate with the cam ring 156 and a pair of circular end plates or sections 172 and 174 (FIGS. 4, 6 and 8) to define a circular array of arcuate pumping chambers 180 (FIG. 12). Although only a few of the pumping chambers 180 have been shown in FIG. 12, the pump assembly 154 has ten pumping chambers 180. A greater or lesser number of pumping chambers could be provided if desired. The pumping chambers 180 hold liquid and/or air and are moved along a circular path as the rotor 162 is rotated in a clockwise direction as viewed in FIG. 12 and indicated by an arrow 182. The rotor 162 is driven by a drive shaft 186 (FIG. 4) in the same manner as the rotor 50 of FIG. 1 is driven by the drive shaft 100.

During rotation of the rotor 162, liquid is supplied to the inlet arcs through passages or conduits 190 and 192 (FIG. 5) formed in one end section 172 and through passages or conduits 194 and 196 (FIG. 7) formed in the other end section 174. As each of the pumping chambers 180 (see FIG. 12) moves along an inlet arc formed in the cam ring 156, the slippers 164 move radially outwardly and the pumping chambers expand to reduce the pressure in the pumping chambers. The reduction in pressure draws liquid from the passages 190–196 into each of the pumping chambers in turn as they move along the inlet arcs.

As the pumping chambers 180 continue to move along the circular path within the cam ring 156, each of the pumping chambers in turn moves away from the inlet arcs to the outlet arcs. As the pumping chambers 180 move along the outlet arcs, the slippers 164 are forced radially inwardly toward the axis of rotation of the drive shaft 186 at a constant rate. The volume of the pumping chambers 180 is thus reduced at a constant rate with movement of the pumping chambers along the outlet arcs, the pressure in the pumping chambers 180 is increased.

During operation of the pump assembly 154, the torque required to drive the assembly decreases as the operating speed of the pump assembly increases above a predetermined speed. The rate at which liquid is discharged from the pump assembly remains substantially constant even though the operating speed of the pump assembly increases. As previously described with respect to the embodiment of the invention shown in FIG. 1, the reduction in torque and constant discharge rate are accomplished by reducing the volume of liquid discharged from the pump assembly on each revolution of the rotor 162 as the speed of operation of the pump assembly 154 increases.

To reduce the volume of liquid which is discharged from the pump assembly during each rotation of the rotor 162, orifices 202, 204 (FIG. 5) are provided in the end section 172 to limit the rate of fluid flow through the passages 190 and 192 to the pumping chambers 180. Similarly, orifices 206 and 208 (see FIG. 7) are provided in the end section 174 to limit the rate at which liquid can flow through the passages 194 and 196 to the pumping chambers 180. At relatively high pump operating speeds, the pumping chambers 180 are only partially filled with liquid as they move along the inlet arcs. The remaining volume of each of the pumping chambers 180 (see FIG. 12) is filled with air. Since each of the pumping chambers is only partially filled with liquid, the volume of liquid discharged from each pumping chamber at the outlet arcs on each revolution of the rotor 162 is decreased. Due to the increasing operating speed of the pump assembly 154, however, the total rate of flow of liquid from the pump assembly remains substantially constant, in the manner indicated by the curve 108 in FIG. 2, as pump operating speed is increased above 2,250 rpms.

The outlet arcs are connected in fluid communication with a pump discharge or pressure chamber 212 (FIG. 4) through a check valve system 216 (FIG. 14) mounted on the end section or pressure plate 174. The check valve system 216 includes a main or base section 220 (FIG. 14) from which a first set of spring fingers 222, 224, 226, 228 and 230 extend radially outwardly. A second set of spring fingers 232, 234, 236, 238 and 240 also extend radially outwardly from the base 220.

The first set of spring fingers 222–230 is connected in fluid communication with a first outlet arc through passages 244, 246, 248, 250 and 252 extending axially through the outer end section or pressure plate 174. The second set of spring fingers 232–240 is connected in fluid communication with a second outlet arc through passages 254, 256, 258, 260 and 262 which also extend axially through the end section 174. The spring fingers 222–240 are formed in one piece with the base section 220 and are biased toward a closed condition (see FIG. 15) by their own natural resilience and by the pump discharge pressure in the chamber 212 (see FIG. 4). Although the spring fingers 222–240 are shown extending radially outwardly from a central base 220, the spring fingers 222–240 could extend radially inwardly from an annular base section connected with the radially outer ends of the spring fingers.

Figure 16:
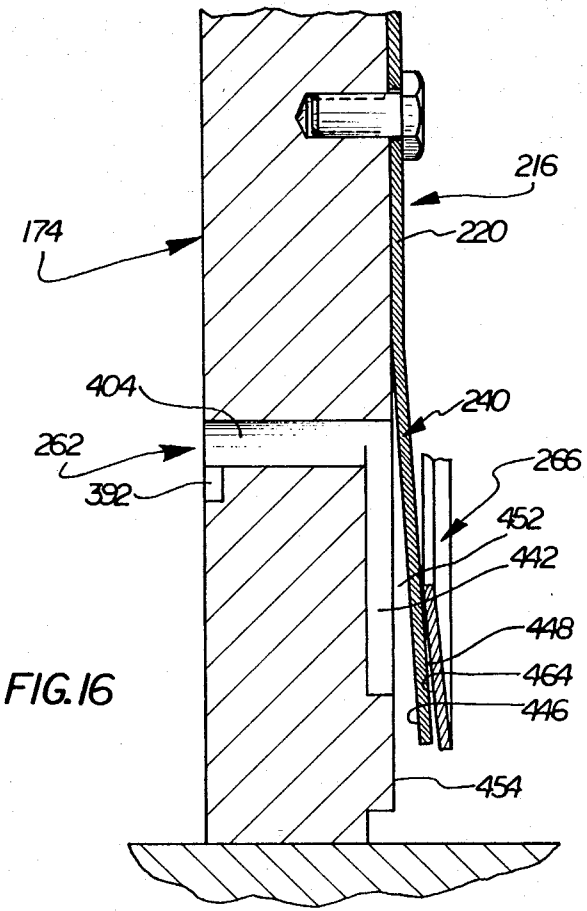
FIG. 16 is a fragmentary sectional view, generally similar to FIG. 15, illustrating the flow control valve in an open condition enabling fluid to flow through the outlet.

When the fluid pressure conducted through the passages 244–262 is sufficient to overcome the natural resilience of the spring fingers 222–240 and the pump discharge pressure to which they are exposed, the spring fingers are moved from the closed condition (FIG. 15) to an open condition (see FIG. 16). When the spring fingers are in the open condition (FIG. 16), fluid can flow from the outlet arcs through the passages 244–262 to the pressure chamber 212. Outward movement of the spring fingers 222–240 from the closed condition illustrated in FIG. 15 to the open condition illustrated in FIG. 16 is limited by a retainer ring 266.

During operation of the pump assembly 154 at relatively low speeds, the rate of flow of liquid through the orifices 202–208 (FIGS. 5 and 7) is sufficient to completely fill each of the pumping chambers 180 (FIG. 12). Since the pumping chambers 180 are completely filled, the fluid pressure in each pumping chamber rapidly increases as the pumping chamber moves from an inlet arc into an outlet arc. The relatively high fluid pressure in the pumping chamber at the beginning of the outlet arc results in each of the spring fingers 222–230 or 232–240 being actuated in turn from its closed condition (FIG. 15) to its open condition (FIG. 16). The chamber is always in fluid communication with two of the spring fingers until the pumping chamber is moved out of the outlet arc. Specifically, each of the outlet arcs has an arcuate extent of 77° so that there is an arcuate distance of approximately 13° between the central axes of the spring fingers. The ten slippers 164 have centers which are spaced apart by an arcuate distance of about 36°. Fluid can thus flow smoothly from the pumping chambers through the ports or passages 244–252 and 254–262 as the pumping chambers move along the outlet arcs.

During operation of the pump assembly 154 at a relatively high speed, for example, 3,500 rpm, the orifices 190–196 restrict the flow of liquid to the pumping chambers 180 as they move along the inlet arcs. Each pumping chamber 180 is only partially filled with liquid and the remainder of the chamber is filled with air which comes out of solution with the liquid. The fluid pressure in the pumping chamber 180 is relatively low as the pumping chamber enters an outlet arc and its volume must be reduced before the fluid pressure in the pumping chamber can overcome the biasing force applied against the spring fingers by the pump discharge pressure in the chamber 212.

As a pumping chamber 180 moves along the outlet arc, the volume of the pumping chamber is decreased at a constant rate. This results in a smooth continuous increase in the fluid pressure in the pumping chamber until the fluid pressure is sufficient to overcome the biasing force against one of the spring fingers 222–230. After one of the spring fingers 222–230 has moved to an open condition, the constant rate of decrease in the distance between the outlet arc and the rotor 62 maintains the pressure in the pumping chamber so that succeeding spring fingers are actuated to an open condition and liquid flows smoothly from the pumping chamber.

As with the embodiment of FIG. 1, the flow of liquid from a pumping chamber 180 is initiated at a location along an outlet arc which will vary with the speed of operation of the pump assembly 154 and the extent to which the pumping chamber is filled with liquid. Thus, at low pump operating speeds, the flow of fluid from a pumping chamber may begin as soon as the chamber comes into fluid communication with the outlet port 244 which communicates with the spring finger 222. At relatively high operating speeds, a flow of fluid from a pumping chamber may not begin until the chamber comes into fluid communication with the outlet port 250 which communicates with the spring finger 228.

The manner in which the fluid pressure in a pumping chamber 180 varies along an outlet arc with variations in pump speed is generally the same as is illustrated in the graph of FIG. 3, until one of the spring fingers opens. After one of the spring fingers 222–230 opens, the pressure in the pumping chamber remains substantially constant at a pressure which is slightly greater than pump discharge pressure.

Pump Assembly—Inlet

The inlet passages 190 and 192 (see FIG. 5) in the end section 172 are connected in fluid communication with an annular reservoir 272. The reservoir 272 is defined by the outer surface of the cam ring 156, the inner surface of a generally cylindrical shell or housing 274 that encloses the cam ring 156, and end sections 172 and 174. The annular reservoir 272 is connected with a main reservoir 276 (FIG. 4) through an opening 278 in the housing 274. The main reservoir 276 is formed by a sheet metal housing 282 which extends around the inner housing 274 and is connected with a remote holding tank (not shown) through a conduit 284. Fluid from a power steering motor is supplied to the remote holding tank during operation of the power steering apparatus.

Figure 6:
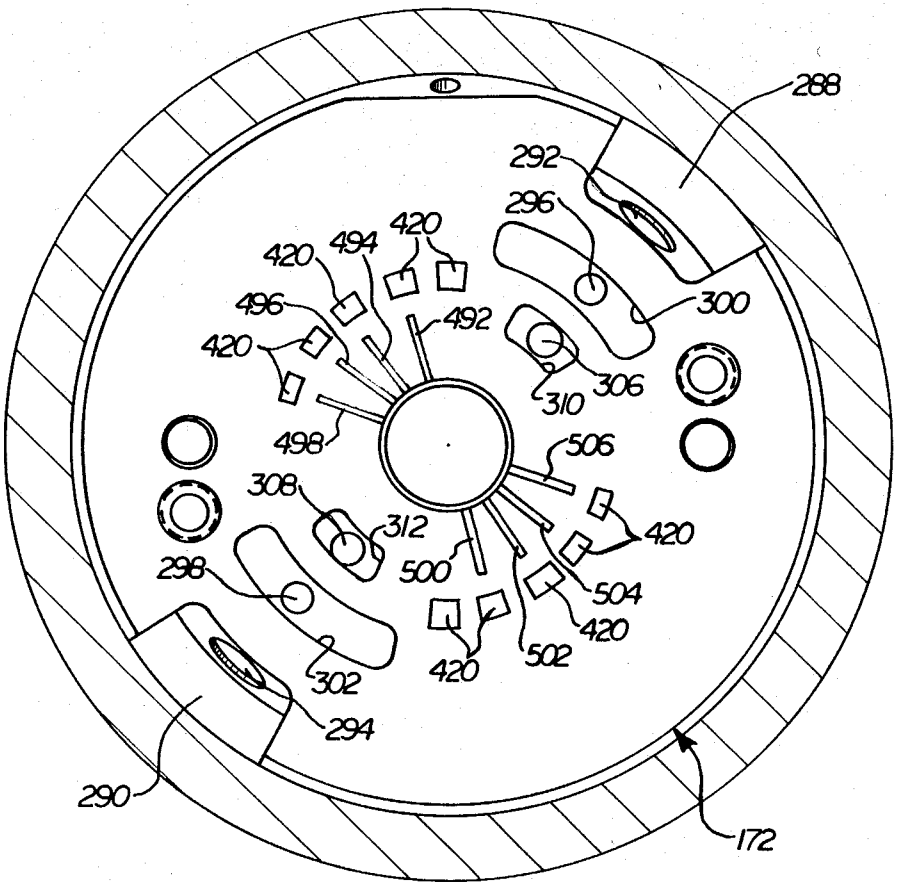
FIG. 6 is a plan view taken generally along the line 6—6 of FIG. 5 and illustrating an inner end plate or section having openings through which fluid flows into the pumping chambers.
Figure 5:
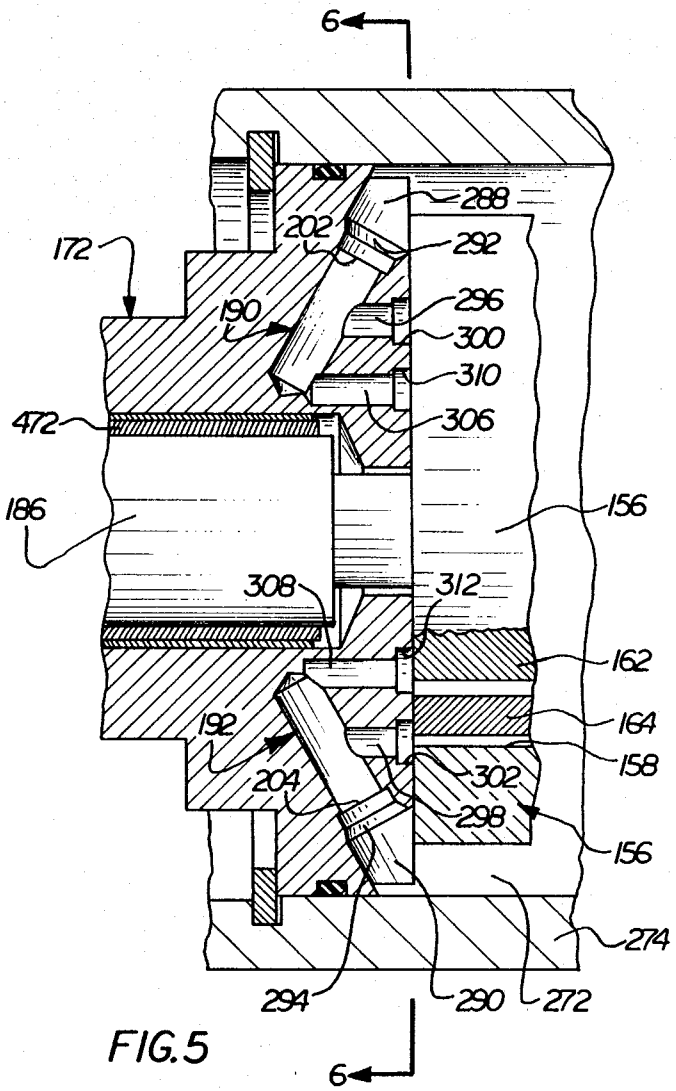
FIG. 5 is an enlarged fragmentary sectional view of a portion of the pump assembly of FIG. 4 and illustrating inlets through which fluid is conducted from a reservoir to pumping chambers as they move along an inlet arc.

During operation of the pump assembly 154, fluid from the reservoir 272 enters the passage 190 and the passage 192 through openings 288 and 290 (see FIGS. 5 and 6). The openings 288 and 290 are connected in fluid communication with circular openings 292 and 294 at the outer end portions of the passages 190 and 192 (FIG. 5). The liquid which flows through the orifices 202 and 204 flows through branch passages 296 and 298 to arcuate inlet recesses 300 and 302 formed in end section 172. Recesses 300 and 302 are exposed to each of the pumping chambers 180 in turn at a location adjacent to the radially outer cylindrical surface 304 (FIG. 12) of the rotor 162 and adjacent to a radially outermost portion of the slippers 164.

The inlet passages 190 and 192 also have branches 306 and 308 (FIG. 5) which are connected in fluid communication with recesses 310 and 312 (FIGS. 5 and 6) formed in the end section 172. The recesses 310 and 312 are exposed to each of the pumping chambers 180 in turn at a location adjacent to the radially innermost surface of each of the slippers 164. By having fluid flow to both the radially inner and radially outer surfaces of the slippers 164 through the branch passages 296, 298, 306 and 308, slipper vibration and operating noise tends to be reduced during operation of the pump assembly 154.

Figure 7:
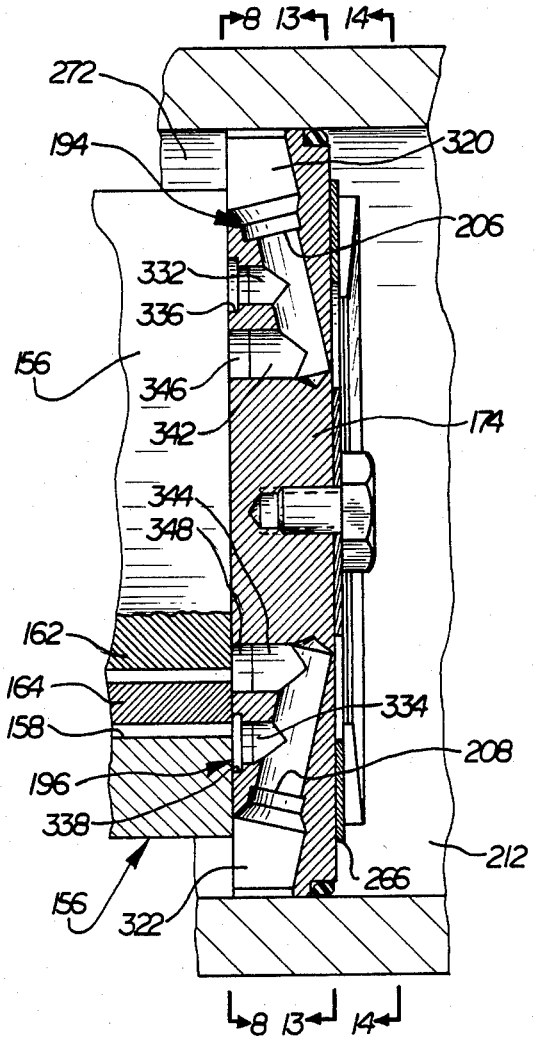
FIG. 7 is a fragmentary sectional view of a portion of the pump assembly of FIG. 4 and illustrating additional inlets through which fluid is conducted from a reservoir to the pumping chambers as they move along the inlet arc.
Figure 10:
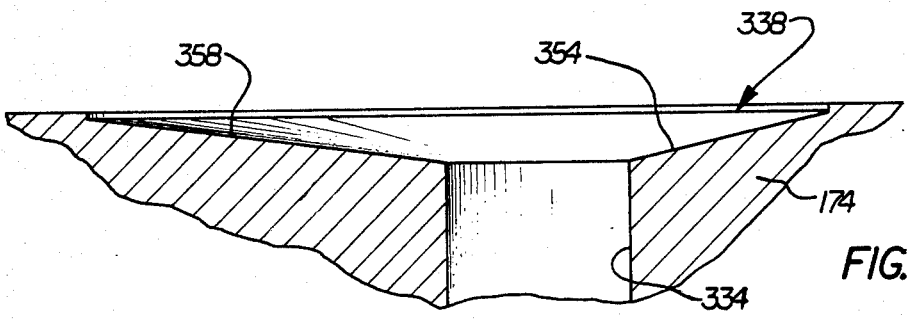
FIG. 10 (on sheet 5 of the drawings) is an enlarged fragmentary sectional view, taken generally along the line 10—10 of FIG. 9, further illustrating the construction of one of a plurality of openings at a fluid inlet.
Figure 11:
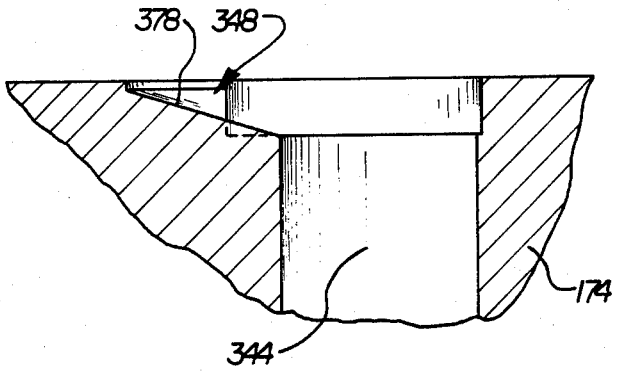
FIG. 11 is a fragmentary sectional view, taken generally along the line 11—11 of FIG. 9, illustrating the construction of another of the openings at the fluid inlet.
Figure 8:
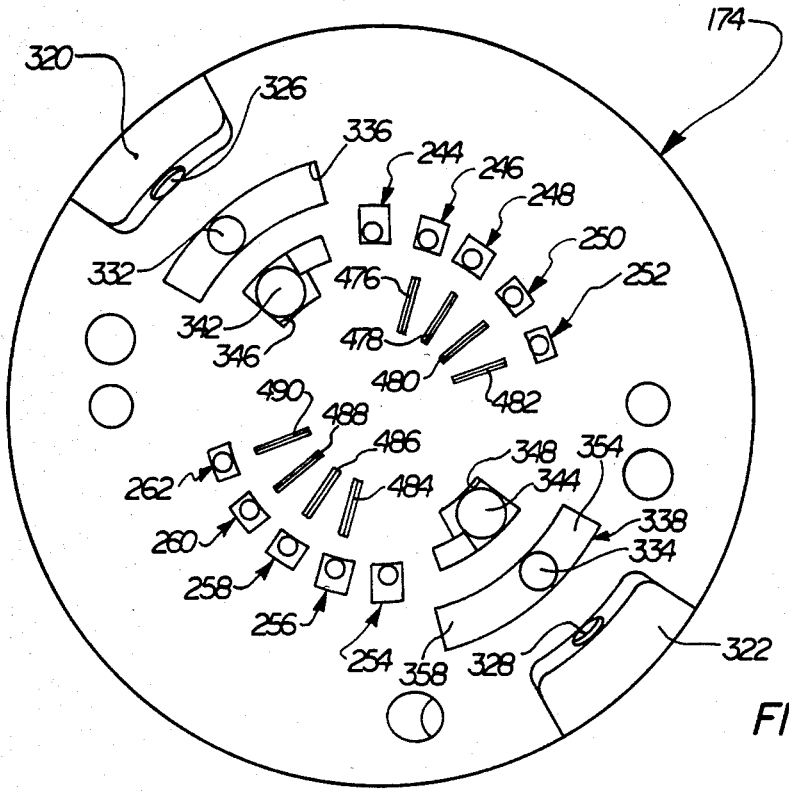
FIG. 8 is a plan view taken generally along the line 8—8 of FIG. 7 and illustrating an outer end plate or section having openings through which fluid flows into the pumping chambers.

To promote even filling of the pumping chambers 180 and thereby minimize noise during operation of the pump assembly 154, the passages 194 and 196 (FIG. 7) in the end section 174 connect the pumping chambers in fluid communication with the annular reservoir 272 in the same manner as do the passages 190 and 192 in the end section 172. Thus, the passages 194 and 196 are connected with the reservoir 272 through openings 320 and 322 (FIGS. 7 and 8). Circular open ends 326 and 328 (FIG. 8) of the passages 194 and 196 are connected in fluid communication with the openings 320 and 322. The passages 194 and 196 (FIG. 7) have branches 332 and 334 (FIG. 7) which are connected in fluid communication with recesses 336 and 338 (FIG. 8). The recesses 336 and 338 are formed in the end section 174 at a location adjacent to the periphery of the rotor 162 (FIG. 12) and cam surface 158. The recesses 336 and 338 (FIG. 8) have the same configuration as the recesses 300 and 302 (FIG. 6). Liquid conducted from the reservoir 272 through the branch passages 332 and 334 (FIG. 7) enters each of the pumping chambers 180 in turn at a location adjacent to a radially outer portion of the slippers 164. Radially inner portions of the slippers 164 are connected in fluid communication with branch passages 342 and 344 (FIG. 7) through recesses 346 and 348 in the end section 174 (FIG. 8). The recesses 346 and 348 are disposed adjacent to radially inner end portions of the slippers 164 (FIG. 12) and have the same configuration as the recesses 310 and 312 (FIG. 6). Therefore, the radially inner and outer surfaces of the slippers are connected at both ends with the reservoir 272 as the slippers move along the inlet arc.

To reduce vibration of the slippers 164 further as they move along the inlet arc, the recesses 336, 338, 346 and 348 (see FIG. 8) are provided with valve surfaces. The valve surfaces provide a gradual change in the fluid pressure to which a pumping chamber 180 is exposed as it is moves along the inlet arc. Thus, the recess 338 (see FIG. 10) has an inlet valving surface 354 which slopes outwardly toward the right (as viewed in FIGS. 9 and 10) away from the branch passage 334. As the pumping chamber moves along the inlet arc, it moves from the right toward the left (as viewed in FIGS. 9 and 10) along the recess 338. The valving surface 354 provides a gradual exposure of the pumping chamber to the branch passage 334 as the pumping chamber enters the inlet arc.

The valving surface 354 has an arcuate extent which is large enough to enable two of the pumping chambers 180 to be connected in fluid communication with the branch passage 334 at the same time (see FIG. 12). In other words, the combined arcuate extent of the valving surface 354 and the branch passage 334 is greater than the arcuate extent of a slipper 164. A first pumping chamber 180 can be fully exposed to the inlet branch passage 334 while the valving surface 354 is initiating fluid communication of the succeeding pumping chamber with the branch passage along the valving surface.

The recess 338 also has a valving surface 358 which slopes toward the left (as viewed in FIGS. 9 and 10) from the branch passage 334. Since a pumping chamber 180 moves from the right to the left (as viewed in FIGS. 9 and 10) along the inlet arc, the valving surface 358 gradually shuts off communication of the branch passage 334 with a pumping chamber 180 as it moves out of the inlet arc. By providing gradual exposure of the pumping chamber to the inlet branch passage 334 and gradual blocking of the pumping chamber from the passage, the valving surfaces 354 and 358 reduce the rate of change in pressure in the pumping chamber as it moves along the inlet arc and thereby reduce slipper agitation and vibration. This reduces pump operating noise due to impingement of the slippers against the cam ring 156 and also reduces operating forces on the pump components. The combined arcuate extent of the valving surface 354, the inlet conduit 334, and the valving surface 358 is greater than the arcuate extent of a pumping chamber 180 (FIG. 12).

The valving surfaces 354 and 358 (FIG. 9) have a width or radial extent along the end section 174 which is approximately equal to the diameter of the inlet branch passage 334. The the leading and trailing edge portions 362 and 364 of the recess 338 and valving surfaces 354 and 358 are parallel to the leading and trailing edge portions 366 and 368 of pockets or slots 370 (see FIG. 12) in which the slippers 164 are disposed as the slipper pockets move past the edge portions 362 and 364.

The volume and arcuate extent of the portions of the pumping chamber 180 contained in the slot 370 radially inwardly of the slipper 164 is less than the volume and arcuate extent of the portion of the pumping chamber disposed radially outward of the rotor. Therefore, the arcuate extent of the recess 348 (FIGS. 9 and 12) is less than the arcuate extent of the recess 338. When a pumping chamber enters the inlet arc, it moves a substantial distance past the edge portion 362 (FIGS. 9 and 12) of the recess 338 before the pumping chamber is exposed to the recess 348. A notch or recess 374 (see FIG. 12) is provided at one axial end portion of the rotor 162 to communicate a leading edge of a slipper slot 370 with the portion of the pumping chamber 180 which is disposed radially outwardly of the peripheral surface of the rotor 162. Therefore, when a pumping chamber 180 moves past the edge portion 362 of the recess 338, the portion of the slot 370 disposed radially inwardly of the slipper 164 is connected in fluid communication with the recess 338 and the branch conduit 334 through the slot 370.

As a pumping chamber 180 moves along the inlet arc, the slipper slot 370 moves into fluid communication with the radially inner recess 348 and branch inlet passage 344 (see FIG. 12). When a pumping chamber 180 moves out of the inlet arc, the trailing edge portion 368 of a slipper slot 370 is exposed to the recess 348 after the pumping chamber 180 has moved out of fluid communication with the recess 338. Therefore, the trailing portion of the pumping chamber 180, that is, the portion disposed in the slipper slot 370, is the last portion of the pumping chamber connected in fluid communication with the pump inlet. The recess 348 has a valving surface 378 (see FIGS. 9 and 11) which gradually shuts off or blocks fluid communication between the slipper slot 370 and the branch conduit 344.

Pump Assembly—Outlet Porting

The cam surface 158 slopes toward the axis of rotation of the rotor 162 at a constant rate along the outlet arcs. Thus, each outlet arc can be considered as being divided into a large number of arcuate increments each of which has the same small arcuate extent. As a slipper 164 moves along each of the arcuate increments in turn, the slipper moves radially inwardly toward the axis of rotation of the rotor 162 through the same radial distance. Therefore, as a pumping chamber 180 moves along an outlet arc, the volume of the pumping chamber is reduced by the same amount for each increment of movement of the pumping chamber along the outlet arc.

Although the precise dimensions of the outlet arc may vary with different embodiments of the invention, the outlet arc will have a substantially greater extent than the inlet arc. The longer arcuate extent of the outlet arc insures that the air in a pumping chamber containing air and liquid will be forced back into solution during high speed operation of the pump. Compressing the air back into solution with the liquid occurs before the check valves 222–240 (see FIG. 14) are opened under the influence of fluid pressure communicated through an associated one of the outlets 244–262.

The outlets 254–262 are spaced apart at equal intervals along the outlet arc. The outlets 254–262 include generally rectangular recesses or openings 384, 386, 388, 390 and 392 (see FIG. 9) formed in the end section 174. The rectangular recesses 384–392 are connected in fluid communication with cylindrical passages 396, 398, 400, 402 and 404 which extend axially of the end section 174. In order to maintain a minimum radial sealing distance between the axial ends of the slippers 164 and the end section 174 along the outlet arc, the recesses 384–392 extend radially outwardly for an extent which decreases along the inwardly sloping outlet arc. Thus, the recess 384 is larger and extends radially outwardly further than the recess 386. Similarly, the recess 386 is larger and extends further radially outwardly along the end section 174 than does the recess 388. This results in the recesses 384–392 extending radially outwardly to substantially the same location along each slipper 164 as it moves along the outlet arc (FIG. 12). Since the recesses 384–392 extend to the same location on a slipper as it moves along the outlet arc, the radial extent of the seal between the slipper and the end section 174 remains substantially constant along the outlet arc.

Fluid is discharged from each pumping chamber 180 to each of the outlets 254–262 at a location which is generally radially inwardly of slipper 164. The fluid is forced out of the slipper slots 370 as the slippers 164 move radially inwardly of the rotor 162. In order to provide fluid communication between the radially outermost portion of the pumping chamber 180 and the outlets 254–262, a groove 408 (FIG. 12) is formed at each axial end of each slipper 164. The grooves 408 provide continuous fluid communication between the radially inner and outer surfaces of the slippers and equalize the fluid pressure on the radially opposite surfaces.

During movement of each pumping chamber 180 along an outlet arc, the fluid pressure in the chamber will tend to vary. At the central portion of the outlet arc, the chamber is spaced farthest from the preceding and succeeding inlet arcs, which are at lower pressures. The distance from the low pressure inlet arcs tends to permit a relatively higher fluid pressure to be developed at the central portion of the outlet arc than at the opposite end portions of the outlet arc. In order to tend to equalize the fluid pressure along the outlet arc, the outlets 256, 258 and 260 have notches 412, 414, 416 and 418 (FIG. 9) which promote fluid leakage from relatively high pressure portions of the outlet arc toward relatively low pressure portions of the outlet arc. For example, since the outlet recess 386 is farther from the relatively low pressure inlet recess 338 (see FIG. 9) than is the outlet recess 384, a higher fluid pressure will be obtained at the outlet recess 386 than at the outlet recess 384. To equalize the fluid pressures at the outlet recesses 384 and 386, a notch 412 extends toward the right (as viewed in FIG. 9) from the outlet recess 386 toward the outlet recess 384. Fluid can leak from the outlet recess 386 to the outlet recess 384 along the notch 412 to tend to equalize the fluid pressures at the two outlet recesses.

The outlet recess 388 is disposed midway along the outlet arc and tends to permit higher pressures to be developed at it than the other outlet recesses 384, 386, 390 and 392. Therefore, the central recess 388 has two notches 414 and 416 that extend in opposite directions toward the outlet recesses 386 and 390 to enable liquid to leak from the central portion of the outlet arc toward the outlet recesses 386 and 390. Finally, the outlet recess 390 is spaced farther from the next succeeding inlet arc than is the outlet recesses 392. To tend to equalize the fluid pressures at the outlet receses 390 and 392, a notch 418 extends from the recess 390 toward the recess 392.

Figure 9:
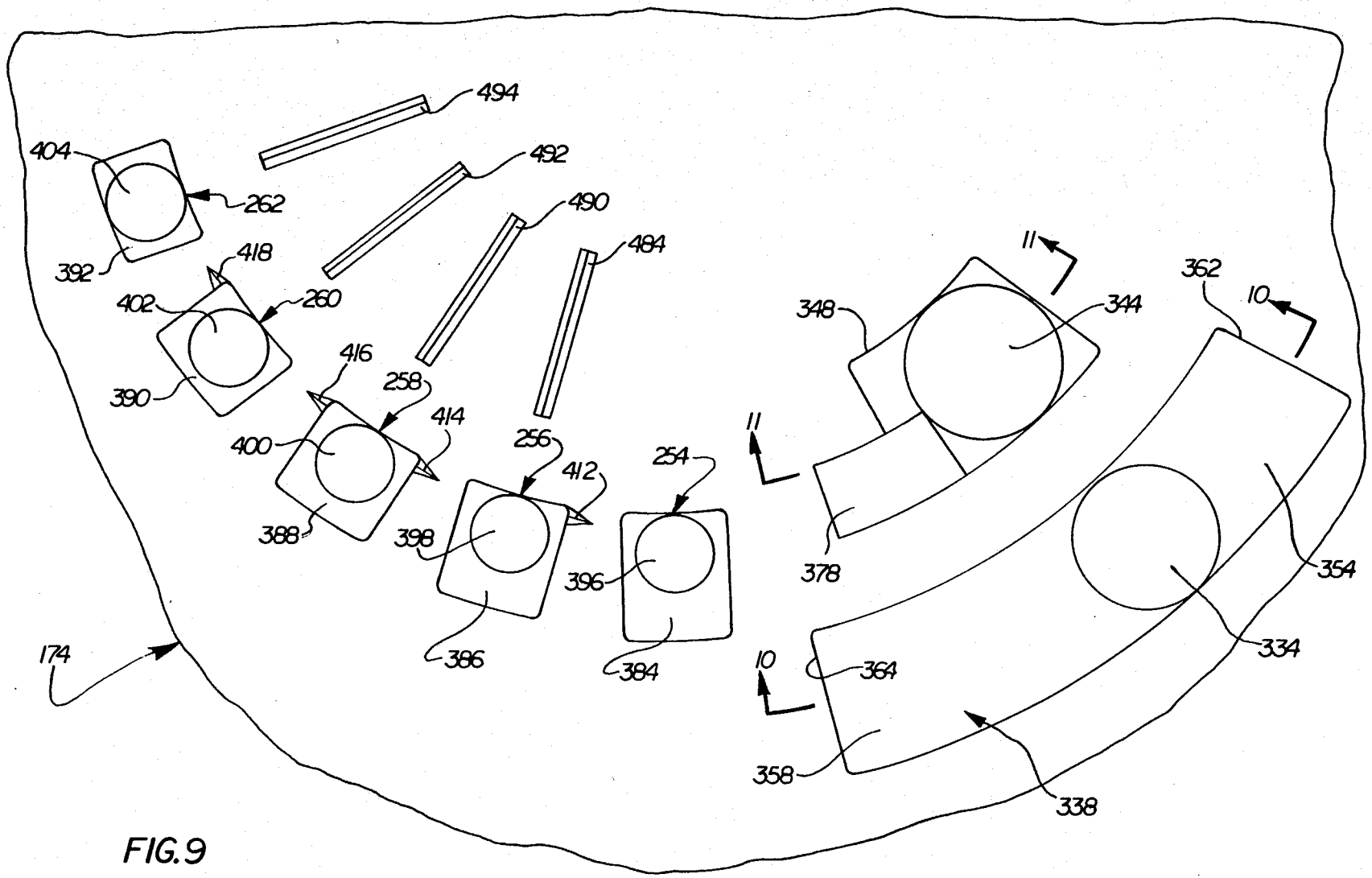
FIG. 9 is an enlarged fragmentary view of a portion of the outer end section of FIG. 8 and illustrating the relationship between inlets through which fluid flows into pumping chambers as they move along the inlet arc and outlets through which fluid flows from the pumping chambers as they move along an outlet arc.

Although only the outlets 254–262 have been illustrated in FIGS. 9 and 12, the outlets 244–252 (FIG. 8) have the same construction as the outlets 254–262. Also, understood that the pumping chambers 180 and slippers 164 cooperate with the outlets 244–252 in the same manner as with the outlets 254–262. Blind or dummy outlet recesses 420 (FIG. 6) are provided in the end or pressure plate 172 to tend to equalize axial fluid pressure forces on the rotor 162.

Figure 13:
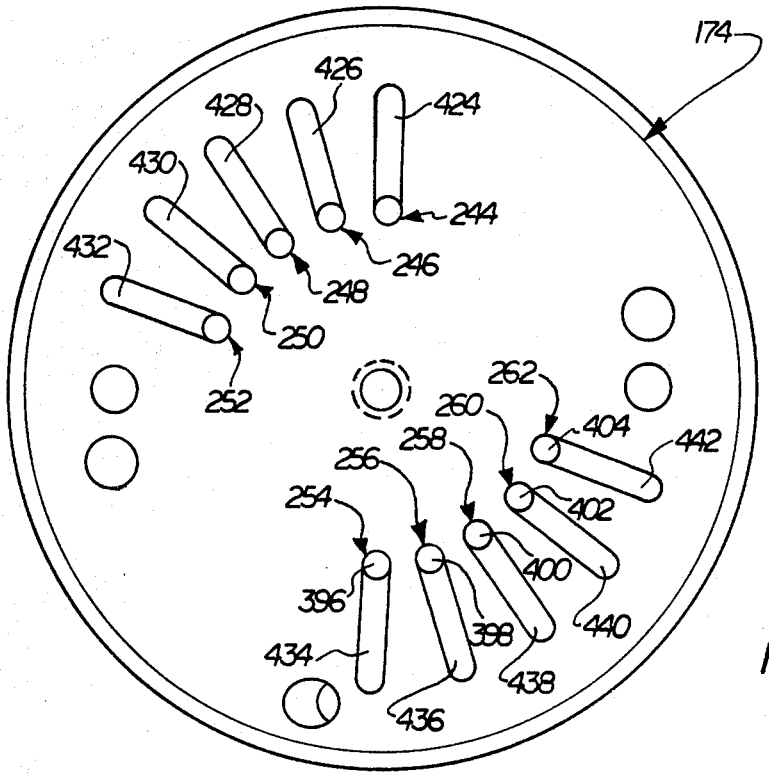
FIG. 13 (on sheet 6 of the drawings) is a plan view, taken generally along the line 13—13 of FIG. 7, illustrating the configuration of elongated outlet cavities formed in the outer end section with flow control valves removed for purposes of clarity of illustration.
Figure 14:
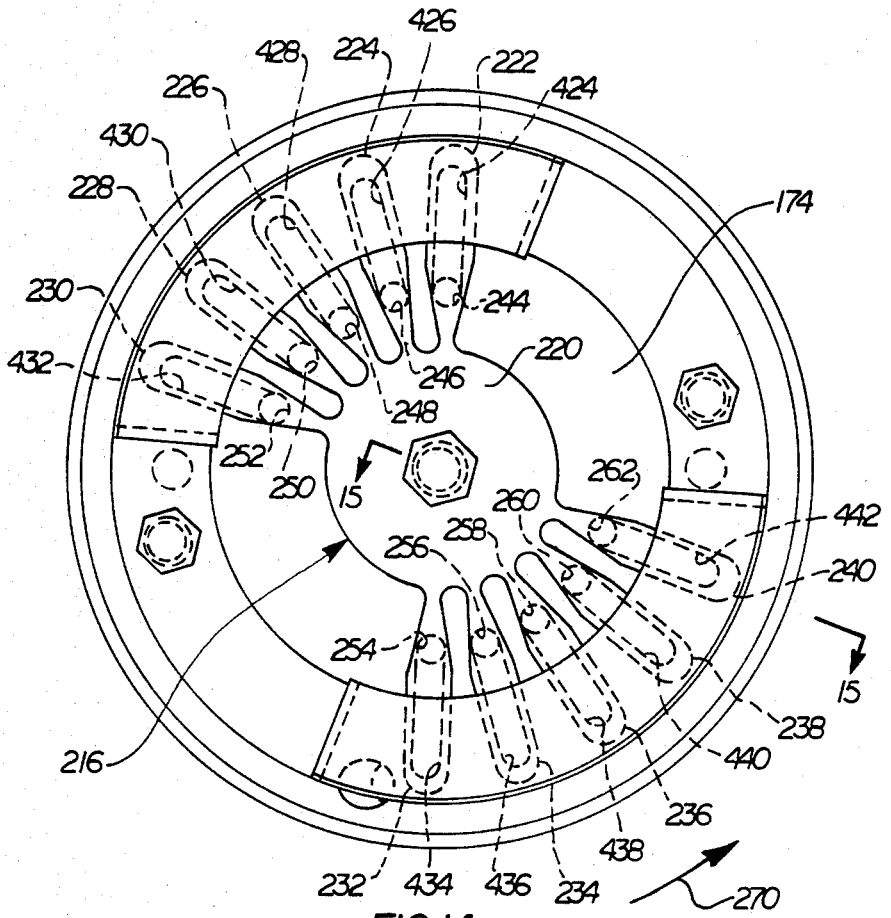
FIG. 14 (on sheet 9 of the drawings) is a plan view taken generally along the line 14—14 of FIG. 7, illustrating the flow control valves.

The spring finger valves 222–240 (see FIG. 14) are exposed to the fluid pressure at the outlets 244–262. When the fluid pressure at the outlets 244–262 becomes great enough, the spring fingers 222–240 are actuated from the closed condition (FIG. 15) to the open condition (FIG. 16). To provide for a smooth flow of fluid through the outlets 244–262 around the open spring fingers 222–240, elongated outlet recesses or cavities 424–432 (FIG. 13) are formed in the back or outer side of the end section 174 at the outlets 244–252. Similarly, elongated recesses 434–442 are formed in the back or outer side of the end section 174 at the outlets 254–262. The elongated recesses 434–442 extend radially outwardly from the passages 396–404 along the inner side of the spring fingers 232–240 (FIGS. 13 and 14).

Figure 4:
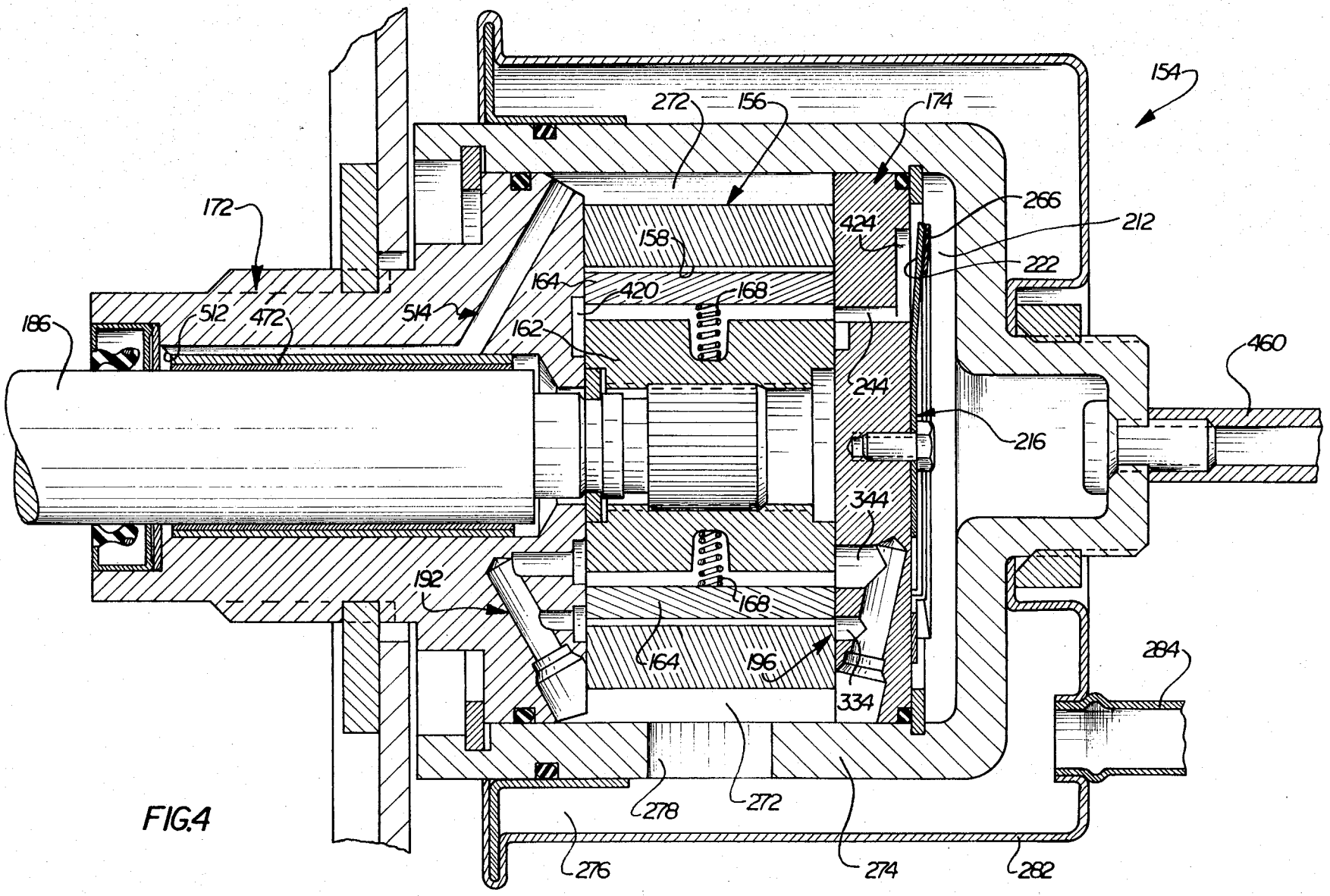
FIG. 4 is a sectional view of one specific preferred embodiment of a pump assembly constructed in accordance with the present invention.

The length of the recesses 424–442 facilitates a smooth flow of fluid from the outlets 244–262. As shown in FIGS. 5 and 16, for example, as the spring finger 240 moves outwardly from the closed position shown in FIG. 15 to the open position shown in FIG. 16, an elongated wedge-shaped opening 452 (FIG. 16) is formed between the inner side surface 446 of the spring finger and an outer major side surface 454 of the end section 174. The relatively long opening 452 enables fluid to flow smoothly out of the recess 442 to the chamber 212 (FIG. 4).

Figure 15:
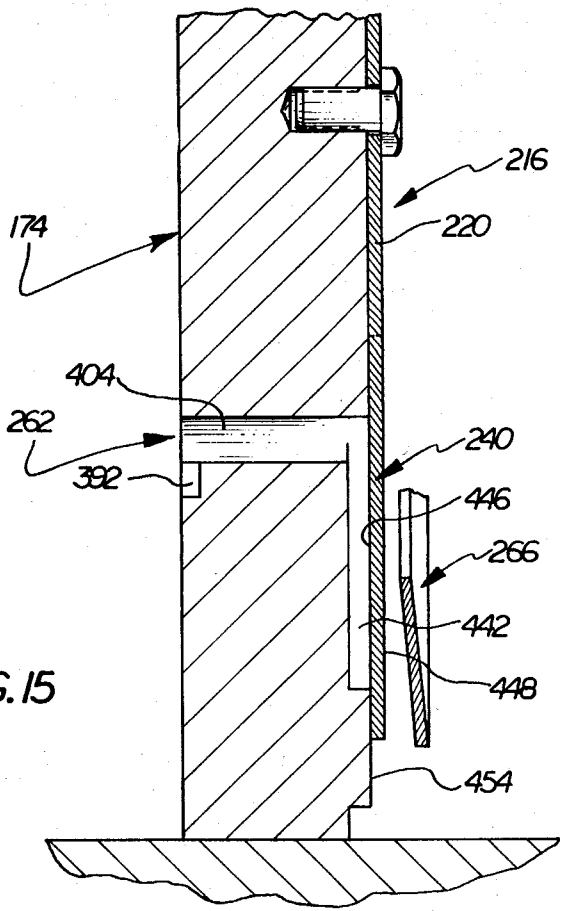
FIG. 15 is an enlarged fragmentary sectional view, taken generally along the line 15—15 of FIG. 14, illustrating the relationship between a flow control valve and an outlet, the flow control valve being shown in a closed condition blocking fluid flow through the outlet.

Once the pressure in a pumping chamber 180 is sufficient to overcome the influence of the fluid pressure in the chamber 212 and the initial resistance of the spring finger 240, movement of the spring finger 240 from the closed position of FIG. 15 to the fully open position of FIG. 16 requires only a small incremental increase in pressure to overcome the slightly increasing resistance of the spring finger 240 to movement. Therefore, the spring finger valve 240 quickly opens to enable fluid to flow smoothly out of the pumping chamber 180 to the pressure chamber 212. The pressure chamber 212 is connected in fluid communication with a power steering control valve (not shown) by a conduit 460 (see FIG. 4) so that the fluid discharged from a pumping chamber can be used by a power steering apparatus in a vehicle.

When the spring finger 240 is moved to the fully open position shown in FIG. 16, the outer side surface 448 of the spring finger abuts an annular inner side surface 464 on the retainer ring 266 to limit outward movement of the spring finger. The retainer ring 266 prevents excessive outward movement of the spring finger 240 so that there is no permanent deformation of the spring finger under the influence of the flow of fluid from a pumping chamber.

Although only the outlets 242–254 have been illustrated in FIGS. 9 and 12, the outlets 244–252 are of the same general construction and cooperate with the pumping chambers 180 in the same manner as do the outlets 254–262. Also, although only the spring finger 240 has been illustrated in FIGS. 15 and 16, the other spring fingers 222–238 are actuated in the same manner as the spring finger 240.

Pump Assembly—Lubrication

During operation of the pump assembly 154, the low pressures at the inlets 190, 192, 194 and 196 (see FIGS. 5 and 7) will tend to draw fluid away from a cylindrical bearing 472 (see FIGS. 4 and 5) which supports the drive shaft 186 for rotation about its central axis. In order to provide lubrication for the bearing 472, lubricant passages 476, 478, 480, 482, 484, 486, 488 and 490 (see FIG. 8) are provided in the end section 174. Similarly, lubricant conducting passages 492, 494, 496, 498, 500, 502, 504 and 506 are provided in the opposite end section 172 (see FIG. 6).

The lubricant passages 476–506 conduct a restricted flow of lubricating fluid along the axially opposite end faces of the rotor 162 to the drive shaft 186 at a location adjacent to the right (as viewed in FIG. 4) end of the cylindrical bearing 472. The fluid is conducted along the bearing 472 to one end 512 of a passage 514 which is connected with the cylindrical reservoir section 272. Therefore, lubricating fluid can flow from the pumping chambers 180 through the lubricant conducting passages 476–506 to the bearing 472. The fluid is then conducted through the passage 514 to the reservoir.

The lubricant conducting passages 476–506 terminate radially inwardly of the slipper slots 370 (see FIG. 12). Therefore, the axially outer end surfaces of the rotor 162 cooperate with the end sections 172 and 174 to restrict the flow of fluid from the pumping chambers 180 to the lubricant conducting passages 476–506.

Pump Assembly—Modification

Figure 17:
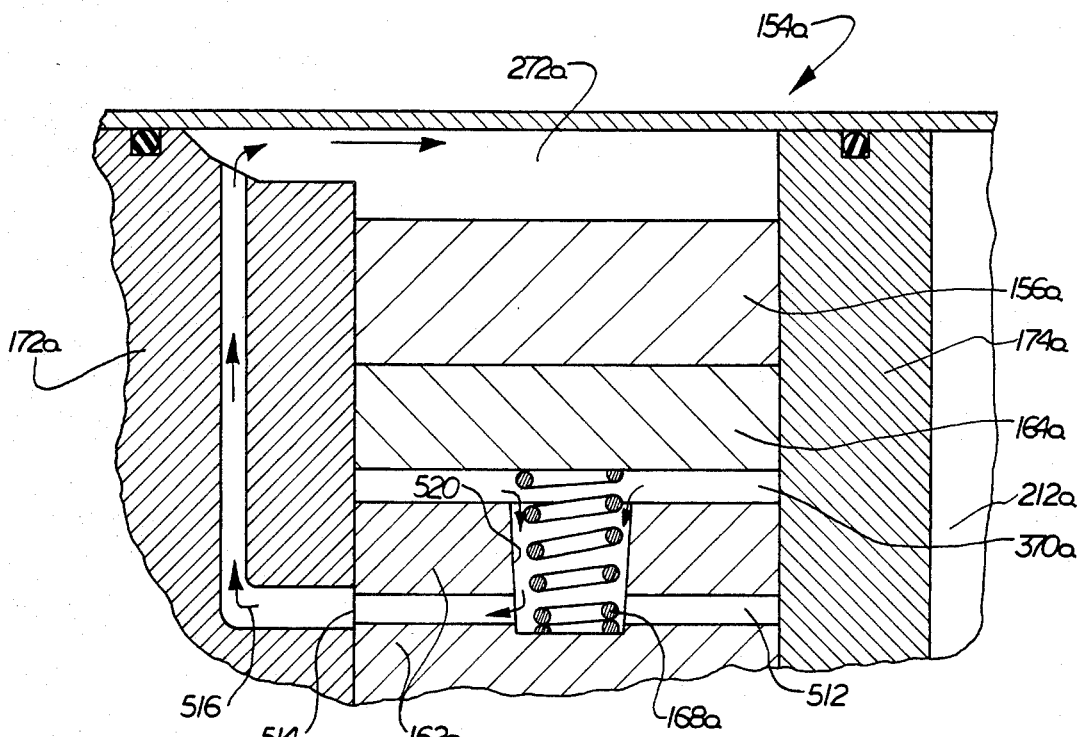
FIG. 17 is a fragmentary sectional view of a portion of a second embodiment of the invention.

Fluid may be trapped in a pumping chamber at the end of an outlet arc. As a result, there may be relatively high fluid pressures in a pumping chamber as it moves into the inlet arc. The relatively high fluid pressures may tend to promote slipper vibration and other noise during operation of the pump assembly. Accordingly, the pump assembly 154 could be modified in the manner shown in FIG. 17 to enable fluid trapped in a pumping chamber to be conducted back to the reservoir and thereby relieve the fluid pressure in the pumping chamber before the pumping chamber moves into fluid communication with the inlet arc. Since the embodiment of the invention shown in FIG. 17 is generally similar to the embodiment of the invention shown in FIGS. 4–16, similar numerals will be utilized to designate similar components, the suffix letter "a" being associated with the numerals of FIG. 17 in order to avoid confusion.

The pump assembly 154*a* includes a cam ring 156*a* which circumscribes a rotor 162*a*. A plurality of slippers 164*a* are pressed against the cam ring by springs 168*a*. End sections 172*a* and 174*a* cooperate with the cam ring 156*a*, rotor 162*a*, and slippers 164*a* to define pumping chambers in the same manner as previously explained in connection with the embodiment shown in FIGS. 4–16.

In this embodiment of the invention, immediately after a slipper 164*a* has moved along the outlet arc and prior to engagement of the slipper with the inlet arc, the radially inner portion of each slipper slot 370*a* is connected in fluid communication with the reservoir 272*a*. An axially extending passage 512 in the rotor 162*a* is connected in fluid communication with an oval inlet opening 514 to a passage 516 formed in the end section 172*a*. The passage 516 is connected in fluid communication with reservoir 272*a*. Liquid or liquid and air trapped beneath the slipper 164*a* can escape from the slipper slot 370*a* through a passage 520 formed in the rotor 262*a*. The fluid is conducted along the passage 512 to the passage 516 which leads to the reservoir.

SUMMARY

The present invention provides a new and improved pump assembly 154 which, once a predetermined operating speed has been reached, reduces the amount of torque required to drive the pump assembly without decreasing the rate of fluid flow from the pump assembly. By reducing the amount of torque required to drive the pump assembly 154 at relatively high speeds, substantial energy savings may be obtained when the pump assembly 154 is used to supply fluid to a power steering control valve on a vehicle. In order to effect a reduction in torque, the pump assembly 154 has fluid inlet orifices which, after a predetermined pump operating speed has been exceeded, restricts the flow of liquid into the pumping chambers 180 so that each pumping chamber is only partially filled with liquid, the remainder of the pumping chamber being filled with air.

As a pumping chamber 180 moves along an outlet arc, the size of the pumping chamber is reduced and the fluid pressure in the pumping chamber is increased. A plurality of outlets 244–262 are disposed along the outlet arcs. Check valves 244–262 (FIG. 14) associated with the outlets. Each check valve is effective to block fluid flow from a pumping chamber 180 through an outlet until the fluid pressure in the pumping chamber is at least as great as the pressure at which fluid is being discharged from the pump assembly. This tends to minimize objectionable backflow and shock waves in the pumping chambers with a resulting reduction in noise generated during operation of the pump assembly.

The check valves 244–262 are resilently deflectable spring fingers. The spring fingers 244–262 are biased toward a closed position under the influence of pump discharge pressure against outer side surface 448 of the spring fingers. The inner side surfaces 446 of the spring fingers 244–262 are exposed to the fluid pressure in each of the pumping chambers 180 in turn. When the fluid pressure in a pumping chamber exceeds the pump discharge pressure, a spring finger is moved from a closed condition blocking fluid flow through a pump outlet to an open condition under the influence of a fluid pressure in a pumping chamber. Although the spring fingers 244–262 can be mounted in many different locations, they are advantageously mounted on an end section 174 of the pump assembly.

The pump assembly 154 is a slipper vane pump and includes a rotor 162 in which pumping elements, i.e., slippers 164, are mounted. A bearing 472 for the rotor 162 is lubricated by fluid conducted from the pumping chambers 180 to the bearing along flow paths which includes passages 476–506 formed between the end sections 172 and 174 (FIGS. 6 and 8) of the pump assembly and the rotor.

Having described specific preferred embodiments of the invention, the following is claimed:

1. A rotary pump assembly comprising cam means for defining fluid inlet and outlet arcs disposed in a circular array, means cooperating with said cam means for defining a plurality of pumping chambers for holding liquid or liquid and air, said plurality of pumping chambers being sequentially movable along a circular path which extends along the inlet and outlet arcs, said means for defining a plurality of pumping chambers includes a rotor rotatable about its central axis and circumscribed by said cam means, a plurality of pumping elements mounted on and rotatable with said rotor and extending radially outwardly into engagement with said means, and first and second end members disposed adjacent to opposite axial ends of said rotor and cooperating with said cam means, pumping elements and rotor to at least partially define said pumping chambers, inlet port means connected in fluid communication with said inlet arc for directing liquid to each of said pumping chambers as it moves along said inlet arc, an array of outlet ports extending along and connected in fluid communication with the outlet arc for conducting fluid flow from each of said pumping chambers as it moves along the outlet arc, said outlet ports being disposed in said first end member, and flow control means for maintaining the rate of flow of liquid from said pump assembly substantially constant at a predetermined flow rate at pump operating speeds above a predetermined speed by reducing the volume of liquid discharged from each of said pumping chambers as it moves along the outlet arc as pump operating speed increases above the predetermined speed, said flow control means including (a) orifice means for limiting the rate of flow of liquid into said pump assembly to the predetermined flow rate as the operating speed of said pump assembly increases above the predetermined speed and (b) valve means for reducing the number of outlet ports through which fluid flow is discharged from each of said pumping chambers as pump operating speed increases above the predetermined operating speed by blocking fluid flow from each of said pumping chambers during pumping chamber movement along the outlet arc through an arcuate distance which increases as the operating speed of said pump assembly increases, said valve means including a plurality of elongated spring fingers each of which is mounted on said first end member and has a fixed end portion and a free end portion movable from a closed condition blocking fluid flow through one of the outlet ports to an open condition under the influence of fluid pressure in one of said pumping chambers, said rotor having an outer circumferential surface which is spaced from an initial end portion of said outlet arc by a first radial distance and which is spaced from a final end portion of said outlet arc by a second radial distance which is smaller than said first distance, said pumping elements being movable radially inwardly toward the central axis of said rotor under the influence of forces applied against said pumping elements by said cam means as the pumping chambers move along the outlet arc, said outlet ports including a plurality of recesses disposed in one of said end members and having radial extents which decrease along the outlet arc from a recess which is disposed adjacent to the initial end portion of the outlet arc and has a relatively large radial extent to a recess which is disposed adjacent to the final end of the outlet arc and has a relatively small radial extent to provide a generally constant spatial relationship between radially outer edge portions of the recess and the pumping elements as the pumping elements move along the outlet arc and move inwardly toward the central axis of said rotor.

2. A pump assembly as set forth in claim 1 wherein at least a portion of the outlet arc has a surface which slopes toward the center of the path of movement of said pumping chambers at a constant rate along the outlet arc from adjacent a first end portion of the outlet arc in the direction of movement of the pumping chambers toward a second end portion of the outlet arc.

3. A pump assembly as set forth in claim 2 further including means for connecting each of said outlet ports in fluid communication with the outlet arc at spaced apart locations along the portion of the outlet arc which slopes at a constant rate.

4. A pumping assembly as set forth in claim 1 wherein said rotor is disposed adjacent to a first radially extending surface of said first end member and said spring fingers are disposed adjacent to a second radially extending surface of said first end member and are oriented radially of the central axis of the rotor.

5. A pump assembly as set forth in claim 4 wherein said outlet ports include a plurality of openings which extend through said first end member and a plurality of elongated grooves which are formed in the second radially extending surface of said first end member and which have longitudinal axes extending radially outwardly from the central axis of the rotor, each of the spring fingers being disposed over one of said grooves, the free end portions of said spring fingers having first surfaces disposed in abutting engagement with said second radially extending surface of said first end member to block fluid flow from said elongated grooves when the free end portions of the spring fingers are in the closed condition, the free end portions of the spring fingers being spaced from said second radially extending surface of said first end member when the free end portions of the spring fingers are in the open condition to enable fluid to flow from said grooves.

6. A pump assembly as set forth in claim 5 further including housing means cooperating with said second radially extending surface of said first end member to define at least partially an outlet chamber to receive fluid discharged from said pumping chambers, the spring fingers having second surfaces exposed to the fluid pressure in said outlet chamber to press the first surfaces of the spring fingers aainst said second radially extending surface of said first end member, the fluid pressure force applied to the second surfaces of the spring fingers varying as a function of the pressure at which fluid is discharged from said pumping chambers.

7. A pump assembly as set forth in claim 1 wherein said pump assembly further including a plurality of passages formed between an axial end surface of said rotor and one of said end members for conducting liquid along at least portions of a plurality of paths extending from said pumping chambers to said bearing means to provide a flow of lubricating liquid to said bearing means.

8. A pump assembly as set forth in claim 7 wherein the one end member includes a flat surface area which is disposed between radially outer ends of said passages and said pumping chambers and which cooperates with the axial end surface of said rotor to restrict the flow of lubricating liquid from said pumping chambers to said bearing means.

9. A pump assembly as set forth in claim 8 wherein said passages are formed in said one end member and extend radially from adjacent said bearing means to said flat surface area of said one end member.

10. A pump assembly as set forth in claim 1 wherein said inlet port means including an inlet passage having an open end adjacent to a radially extending surface of one of said end members and first valving surface means which slopes in the direction of movement of said pumping elements from the open end of said inlet passage toward the radially extending surface of the one end members to provide for a gradual blocking of fluid communication between said inlet passage and each of said pumping chambers in turn as the pumping chambers move out of the inlet arc.

11. A pump assembly as set forth in claim 10 further including second valving surface means which slopes in a direction opposite to the direction of movement of said pumping elements from the open end of said inlet passage toward the radially extending surface of the one end member to provide for a gradual increase in fluid communication between said inlet passage and each of said pumping chambers in turn as the pumping chambers move into the inlet arc.

12. A pump assembly as set forth in claim 1 wherein outlet ports adjacent to opposite ends of the array of outlet ports are disposed adjacent to areas of relatively low pressure whereby fluid tends to leak from the outlet ports at the ends of the array of outlet ports toward the areas of relatively low pressure, said pump assembly further including means for promoting a leakage of fluid from outlet ports in a central portion of the array of outlet ports toward the outlet ports disposed adjacent to the ends of the array of outlet ports to tend to equalize the fluid pressure between the outlet ports disposed in the central portion of the array of outlet ports and the outlet ports disposed at the ends of the array of outlet ports.

13. A rotary pump assembly which reduces the volume of liquid discharged from said pump assembly on each revolution when the operating speed of said pump assembly is increased from a first operating speed to a second operating speed, said pump assembly comprising a rotor rotatable about its central axis, a rotatable drive shaft connected with said rotor for rotating said rotor at different speeds about its central axis during operation of said pump assembly at different speeds, a cam ring circumscribing said rotor and having a radially inner circumferential surface defining an inlet arc and an outlet arc, said outlet arc having a configuration such that the radial distance between the central axis of said rotor and said outlet arc decreases by the same amount along equal arcuate increments of said outlet arc throughout the extent of said outlet arc, a plurality of pumping elements connected with said rotor and extending radially outwardly of a radially outer circumferential surface of said rotor into engagement with the inner surface of said cam ring, said pumping elements being movable radially toward and away from the central axis of said rotor during rotation of said rotor relative to said cam ring, first and second end members disposed adjacent to opposite axial ends of said rotor, said cam ring, end members and pumping elements cooperating to at least partially define a plurality of arcuate pumping chambers disposed in a circular array between the radially outer surface of said rotor and the radially inner surface of said cam ring, each of said pumping elements being sequentially movable toward the axis of rotation of said rotor through an incremental distance which is the same for each arcuate increment of movement of each of said pumping elements along said outlet arc, inlet means connected in fluid communication with said inlet arc for conducting liquid to each of said pumping chambers in turn at a flow rate which is sufficient to at least substantially fill each of the pumping chambers with liquid as each pumping chamber moves along the inlet arc during operation of said pump assembly at the first speed, said inlet means including means for restricting the rate of flow of liquid to each pumping chamber in turn to a flow rate which is insufficient to fill each pumping chamber with liquid as said pumping chamber moves along the inlet arc at the second operating speed which is greater than the first operating speed, an arcuate array of outlets disposed in said first end member and connected in fluid communication with the outlet arc, said outlets including a plurality of recesses disposed in said first end member and having radial extents which decrease along the outlet arc from a recess which is disposed adjacent to the initial end portion of the outlet arc and has a relatively large radial extent to a recess which is disposed adjacent to the final end of the outlet arc and has a relatively small radial extent to provide a generally constant spatial relationship between radially outer edge portions of said recesses and said pumping elements as said pumping elements move along the outlet arc and move inwardly toward the central axis of said rotor, said outlets further including a plurality of passages each of which extends from one of said recesses to an outer side of said first end member, valve means for reducing the number of outlet passages through which fluid flow is discharged from each of said pumping chambers in turn as pump operating speed increases above a predetermined operating speed by blocking fluid flow from each of said pumping chambers in turn during movement of each of said pumping chambers along the outlet arc through an arcuate distance which increases as the operating speed of the pump assembly increases above the predetermined operating speed, said valve means including a plurality of elongated spring fingers each of which has a first end portion fixedly connected to said first end member and a free end portion movable from a closed condition blocking fluid flow through one of said outlet passages to an open condition under the influence of fluid pressure in said one of said outlet passages, and pressure chamber means for holding fluid at a pressure which varies as a function of variations in the pressure at which fluid is discharged from said pump assembly during operation of said pump assembly, each of said spring fingers being urged toward the closed condition under the influence of a fluid pressure corresponding to the fluid pressure in said pressure chamber means to maintain each of said spring fingers in the closed condition until the fluid pressure in one of said pumping chambers is sufficient to overcome the influence of the fluid pressure corresponding to the fluid pressure in said pressure chamber means.

* * * * *